US005236566A

United States Patent [19]

Tsuchiya et al.

[11] Patent Number: 5,236,566

[45] Date of Patent: Aug. 17, 1993

[54] VERTICAL TYPE STREAM PLATING APPARATUS

[75] Inventors: Kiyohide Tsuchiya; Michihiro Shimamura; Katsuaki Nakagawa; Shuji Masuda; Kazuhiro Marumo; Tadashi Ogata, all of Kitakyushu, Japan

[73] Assignees: Nippon Steel Corporation, Tokyo; Nittetsu Plant Designing Corp., Fukuoka, both of Japan

[21] Appl. No.: 948,180

[22] Filed: Sep. 21, 1992

[30] Foreign Application Priority Data

| | | | |
|---|---|---|---|
| Sep. 24, 1991 | [JP] | Japan | 3-243475 |
| Sep. 24, 1991 | [JP] | Japan | 3-243476 |
| Sep. 24, 1991 | [JP] | Japan | 3-243477 |
| Sep. 24, 1991 | [JP] | Japan | 3-243478 |
| Dec. 20, 1991 | [JP] | Japan | 3-338899 |
| Feb. 27, 1992 | [JP] | Japan | 4-041723 |
| Jun. 1, 1992 | [JP] | Japan | 4-140616 |

[51] Int. Cl.[5] ..... C25D 17/00

[52] U.S. Cl. ..... 204/206

[58] Field of Search ..... 204/206

[56] References Cited

U.S. PATENT DOCUMENTS 4,601,794 7/1986 Tsuda et al. .

FOREIGN PATENT DOCUMENTS

| | | |
|---|---|---|
| 273881 | 7/1988 | European Pat. Off. . |
| 5690999 | 7/1981 | Japan . |
| 60-56092 | 4/1985 | Japan . |
| 61-64897 | 4/1986 | Japan . |
| 61-90860 | 6/1986 | Japan . |
| 63303093 | 12/1988 | Japan . |
| 192399 | 4/1989 | Japan . |
| 2-57959 | 4/1990 | Japan . |
| 3-35395 | 5/1991 | Japan . |

*Primary Examiner*—T. M. Tufariello

*Attorney, Agent, or Firm*—Wenderoth, Lind & Ponack

[57] ABSTRACT

The present invention relates to a vertical type stream plating apparatus for plating the surface of a metal strip with tin, chromium, copper or the like. Fundamentally, the apparatus comprises an electrolyte feeding nozzle for feeding an electrolyte into a space between electrodes, a side seal provided on both sides in the widthwise direction of the electrode and a pressure equalizing chamber provided on the backside of the electrode. The apparatus further comprises a electrode having a plurality of through holes communicating with the pressure equalizing chamber provided in an electrode box, waste electrolyte equipment provided with a waste electrolyte box for gathering and discharging the electrolyte and a seal equipment provided at the lowermost portion of the apparatus for preventing the outflow of the electrolyte. The above constitution enables the flow rate distribution of the electrolyte in the widthwise direction of the strip to be made more homogeneous than the prior art and enables the flow rate of the electrolyte to be increased without causing problems of vibration (fluttering phenomenon) of the strip and adsorption of the strip to the electrode, which contributes to an increase in the speed of plating and an improvement in the quality of plating.

8 Claims, 17 Drawing Sheets

VERTICAL TYPE STREAM PLATING APPARATUS

BACKGROUND OF THE INVENTION

The present invention relates to a vertical type stream plating apparatus for electroplating the surface of a metal strip with tin, chromium, copper or the like. In a vertical type stream plating apparatus, in order to improve productivity by increasing the plating rate (deposition rate of a plating metal), it is necessary to circulate a solution for plating a strip between electrodes at a higher speed. The present invention is directed to a vertical type stream plating apparatus that enables a high speed plating treatment to be effected by improving the structure of the plating solution feeding nozzle and the electrolytic cell.

DESCRIPTION OF THE PRIOR ART

Many proposals have been made concerning a technique for electroplating a metal strip at a high current density in a vertical type stream plating apparatus.

For example, Japanese Examined Patent Publication (Kokoku) No. 3-35395 proposes a method as shown in FIG. 1 wherein an electrolyte is fed into a space between a strip 1 and an electrode 2 to impart an agitation effect, thereby attaining a high current density.

According to FIG. 1, a strip 1 that travels between electrodes 2 is plated with an electrolyte ejected from a jet header 3 provided at one end in the longitudinal direction of the electrodes 2.

The conventional electroplating apparatuses had the following problems.

(1) Pressure fluctuation occurs in a portion of an electrolyte feeding nozzle for feeding an electrolyte into a space between the electrodes or a portion between electrodes, which causes the strip to come into contact with the electrodes (short circuiting) or the strip to vibrate (give rise to a fluttering phenomenon), so that flawing or breaking occurs in the product. This influence is significant when the thickness of the strip is as small as 0.3 mm or less.

(2) When the traveling speed is further increased, a gas generated during electroplating is led by the strip, so that the gas cannot be completely removed from the space between the electrode portions, which gives rise to a failure in plating.

(3) Since the flow of the electrolyte is heterogeneous in a widthwise direction of the strip, the thickness of the plating or the quality of the plating becomes heterogeneous.

In connection with these problems, individual components of the conventional plating apparatus have the following problems.

A feeding nozzle is used in various applications including the feeding of a solution, such as an acid solution or a plating solution, on the surface of a sheet.

Specifically, with respect to a feeding nozzle for feeding a solution, such as an acid solution or a plating solution, at a uniform flow rate on the surface of a sheet to be treated, for example, a feeding nozzle as shown in FIG. 2 is disclosed in Japanese Unexamined Patent Publication (Kokai) No. 61-90860, and a feeding nozzle as shown in FIG. 3 is disclosed in Japanese Unexamined Patent Publication (Kokai) No. 61-64897.

These feeding nozzles, however, encounter a significant limitation when conducting a high efficiency and high quality plating operation via the feeding of a large volume of a plating solution, which has been the trend in recent years.

In particular, when the material to be plated is a strip having a thickness as small as about 0.3 mm or less, if pulsation or vibration is large, the pulsation or vibration causes the strip to crinkle or break, which makes it necessary for the solution stream to be made much less liable to pulsation or vibration. Further, when the thickness of the plating must satisfy a strict control standard, the flow rate distribution in the widthwise direction of the strip should be homogeneous.

With respect to an electrode box, Japanese Examined Patent Publication (Kokoku) No. 3-35395 proposes an electrode structure wherein a feeding nozzle is provided on an electrode placed opposite a strip. Further, Japanese Unexamined Utility Model (Kokai) No. 2-57959 proposes an electrode structure wherein a number of holes are provided in an electrode to prevent a strip from adsorbing on the electrode.

The problem of the prior art is that in an electrode structure wherein a feeding nozzle is provided on an electrode, the strip is adsorbed on the electrode or gives rise to vibration (fluttering phenomenon), which becomes significant when the flow rate of the plating solution in the space between the electrodes is increased so that the current density can be increased for high efficiency plating, which has been the trend in recent years, or the distance of the strip from the electrode is reduced so as to minimize power consumption.

Further, there is a tendency towards reducing the thickness of the strip, and a wide variety of materials can be used as the strip material, which increases the possibility that in some material, breaking or crinkling will occur owing to vibration (fluttering phenomenon) and may result in a defective product.

As described above, the conventional electrode structure cannot prevent vibration (fluttering phenomenon) of the strip or adsorption of the strip on the electrode when a plating solution is forcibly fed into a narrow space between the electrodes; the thickness of the strip ($t=0.3$ mm or less) and the tensile strength of the strip is small.

In particular, in an electrode structure wherein a number of holes are simply provided in an electrode, the outflow of the electrolyte cannot be avoided, so that it is very difficult to ensure a high flow rate of the plating solution fed into the space between the electrodes.

With respect to liquid seal equipment provided at the bottom of the cell body, for example, Japanese Examined Patent Publication (Kokoku) No. 3-35395 discloses seal equipment comprising a rotary seal 5 and a connecting part 8 as shown in FIG. 1.

The liquid seal equipment shown in FIG. 1 has two problems. The first problem is that it is difficult to regulate the flow rate. Specifically, in order to always store a predetermined amount of a solution in the cell the rotary seal 5 should be rotated at a proper position according to the feed rate. A variation in the rotation angle leads to a significant variation in the flow rate. For this reason, it is impossible to properly regulate the flow rate because of the outflow of the solution from the top of the tank to the outside of the system, and the impossibility of storing a predetermined amount of the solution within the tank body, etc.

The second problem is that when the strip 1 is thin, the strip comes into contact with the wall of the connecting part 8 located on the rotary seal 5, or is bent with a lip 9 at the end of the rotary seal 8 serving as a fulcrum.

Specifically, when a difference in the rotation angle between the rotary seals 5 provided opposite each other leads to a difference in the flow rate of the solution discharged from individual rotary seals 5, the strip moves towards a higher flow rate, which gives rise to problems such as contact of the strip with the wall of the connecting part 8 provided on the rotary seal or the occurrence of bending in the strip with the rotary seal 5 serving as a fulcrum, which also occurs when there is a difference in the flow rate of the solution fed from the jet header 3.

Further, there is liquid seal equipment consisting of a damroll alone. In the liquid seal equipment consisting of a damroll alone, it is substantially difficult to conduct liquid sealing. Specifically, in practical use, the damroll should be moved left and right and upward and downward for grinding or regulation of the position, which causes a gap to be formed between the damroll and the jet header in contact with the damroll, so that the solution leaks out from the gap.

The plating apparatus proposed as a conventional technique for conducting a plating operation at a higher current density in the above-described Japanese Examined Patent Publication (Kokoku) No. 3-35395 also has the following problems. Specifically, a considerable amount of electrolyte should be fed to a feeding nozzle for feeding the electrolyte to the electrode for the purpose of attaining the agitation effect of the electrolyte, and for this reason, an increase in the amount of feed of the electrolyte not only leads to an increase in the amount of electrolyte but also is inexpedient from the viewpoint of cost.

In general, the capacity of the storage tank should be 2 to 4 times the amount of feed of the solution per minutes, and the volume of piping increases proportionally with an increase in the amount of feed of the solution.

The present invention has been made with a view to eliminate the above-described problems of the prior art, and an object of the present invention is to provide a vertical type stream plating apparatus that can increase the flow rate of the electrolyte in the space between the electrodes, homogenize the flow rate on both surfaces of the strip and in the widthwise direction of the strip, enhance the current density, minimize power consumption, minimize vibration (fluttering phenomenon) of the strip and prevent the adsorption of the strip on the electrode, thus enabling a high quality and high efficiency plating operation.

SUMMARY OF THE INVENTION

The subject matter of the present invention resides in a vertical type stream plating apparatus for treating the surface of a metal, comprising a pair of facing electrodes with a predetermined space therebetween; said space containing an electrolyte stream in the longitudinal direction of said electrodes, and a metal strip travelling through the space between said electrodes for electroplating said metal strip; said plating apparatus further comprising:

a nozzle for feeding said electrolyte into the space between said electrodes to form said electrolyte stream; said nozzle being provided at a bottom or top portion of said apparatus;

an electrode box containing said electrodes therein; said electrode box having a pressure equalizing chamber for equalizing the pressure between the front face and the backside of said strip; said pressure equalizing chamber being provided on the backside of each electrode having a large number of through holes 52 for leading said electrolyte into said pressure equalizing chamber; said pressure equalizing chamber having a sideseal formed at both ends of said electrodes by a plurality of short side blocks in the widthwise direction of each electrode;

a waste electrolyte equipment provided with a waste electrolyte box for gathering and discharging the electrolyte discharged from said space between said electrodes; and seal equipment provided at the bottom portion of said stream plating apparatus for preventing the outflow of the electrolyte.

The electrolyte feeding nozzle according to the present invention comprises a primary nozzle chamber and a secondary nozzle chamber partitioned from each other by a partition wall, an electrolyte feeding port provided on both sides of said first chamber, a slit provided between said primary and secondary chambers; said slit having a space of a size gradually increasing from the center to both sides and an electrolyte jetting port having an identical port space in the widthwise direction of the nozzle for feeding said electrolyte to said strip.

The electrode box according to the present invention comprises said side seal for sealing both ends of the electrodes for preventing the outflow of said electrolyte from both sides of said electrodes; said pressure equalizing chamber provided on the backside of each electrode, a communicating portion for communicating said pressure equalizing chambers to each other, and said plurality of through holes 52 provided in said electrodes for leading said electrolyte from a strip into each of the said pressure equalizing chambers.

The waste electrolyte equipment according to the present invention comprises a flow regulation valve for regulating the flow rate of waste electrolyte discharged from a waste electrolyte outlet provided at the bottom of the electrode box, a sealing device provided at an outlet for the strip of said waste electrolyte box, a partition wall surrounding the strip provided inside the waste electrolyte box; said partition wall having a plurality of through holes. Further, the waste electrolyte equipment comprises a waste electrolyte box for discharging waste electrolyte through a waste electrolyte outlet provided at the top of the electrode box, a partition wall surrounding said strip provided inside said waste electrolyte equipment; said partition wall having a plurality of through holes.

The seal equipment according to the present invention comprises a pair of damrolls pressed against each other with said strip being sandwiched therebetween and rotatably following the travel of said strip, a seal plate provided on each damroll, an edge seal of said damroll combined with said seal plates on both sides and a seal ring provided in a space between said edge seal and the edge of said damroll.

Further, the subject matter of the present invention resides in a vertical type stream plating apparatus comprising at least one of a pair of two electrolytic cells for treating the surface of a metal, comprising a pair of facing electrodes provided while leaving a predetermined space therebetween; said space containing an electrolyte stream in the longitudinal direction of said electrodes, and a metal strip travelling through the space between said electrodes for electroplating said metal strip; said plating apparatus further comprising:

a primary electrolyte feeding nozzle provided at the bottom of one electrolytic cell, an intermediary electrolyte reservoir provided at the upper portion of said primary electrolyte feeding nozzle, a secondary electrolyte feeding port provided at the upper portion of the other electrolytic cell, electrolyte discharge equipment provided at the bottom of said electrolytic cell, and a communicating pipe for communicating said intermediary electrolyte reservoir to said secondary electrolyte feeding port.

The constituent features of the present invention will now be described in more detail with reference to the accompanying drawings.

DESCRIPTION OF PREFERRED EMBODIMENTS

Figure 1:
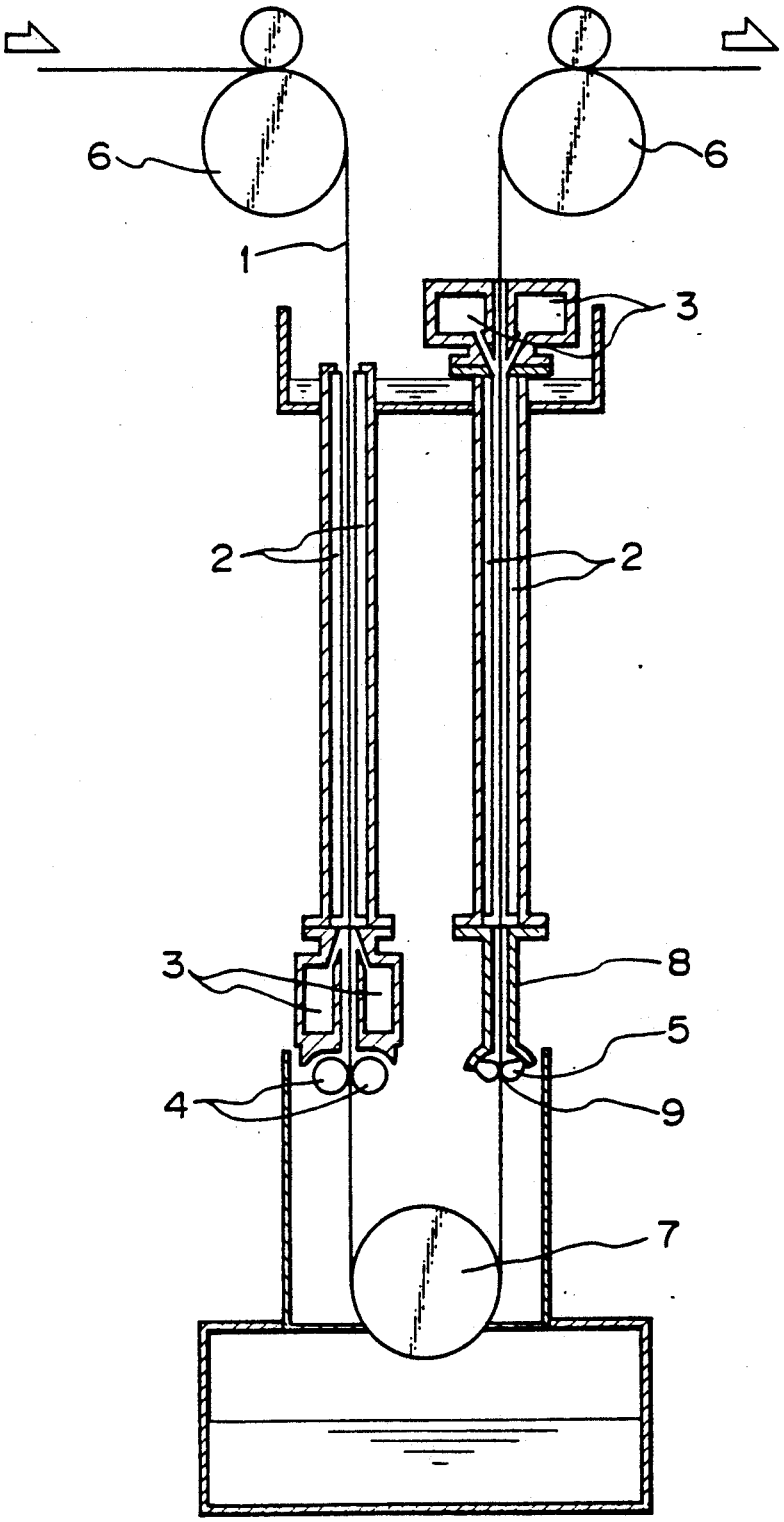
Fig. 1 PRIOR ART
FIG. 1 is a sectional side longitudinal view of a conventional vertical type stream plating apparatus.
Figure 2:
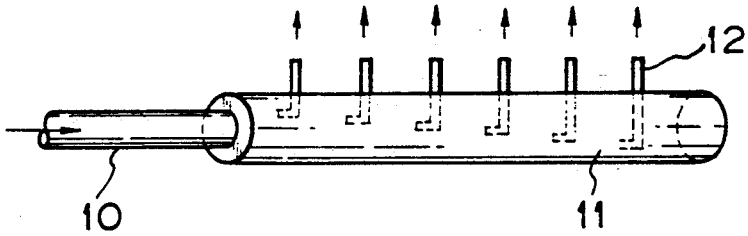
Fig. 2 PRIOR ART
FIG. 2 is an explanatory view of a conventional electrolyte feeding nozzle.
Figure 3A:
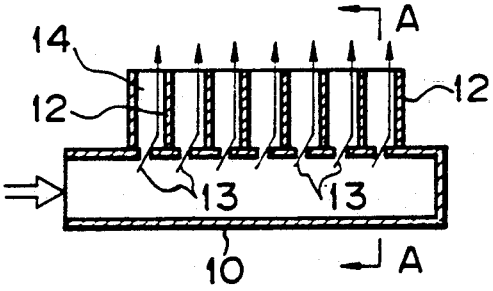
Fig. 3(a) PRIOR ART
FIG. 3 is an explanatory view of a conventional electrolyte feeding nozzle, wherein (a) is a side view and (b) is a sectional view taken on line A—A of (a)
Figure 3B:
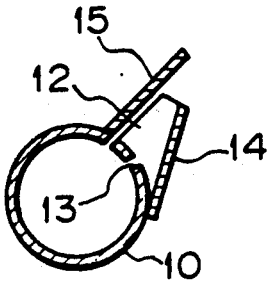
Fig. 3(b) PRIOR ART

As described above, since the vertical type stream plating apparatus according to the present invention comprises an electrolyte feeding nozzle, an electrolyte box, waste electrolyte equipment and a lower seal equipment, the circulation of an electrolyte in a pair of vertical type stream plating apparatuses can be independently regulated, which facilitates the regulation of the flow rate in individual vertical type stream plating apparatuses. Further, in a conventional apparatus described in Japanese Examined Patent Publication (Kokoku) No. 3-35395 wherein a rotary seal is provided on the side of a lower waste electrolyte, it is very difficult to regulate the amount of the waste electrolyte, so that neither the proper flow rate nor the proper flow rate distribution can be attained. By contrast, the provision of waste electrolyte equipment according to the present invention facilitates the regulation of the amount of the waste electrolyte, which enables a proper flow rate or flow rate distribution to be attained.

Further, since a seal equipment is provided at the bottom of waste electrolyte equipment and at the bottom of the electrolyte feeding nozzle, no leakage of the electrolyte occurs, so that the occurrence of a heterogeneous flow rate distribution and the amount of the electrolyte in an electrolyte receiver derived from leakage of the electrolyte can be remarkably reduced.

Further, the provision of a side seal at both ends of the electrode box in the widthwise direction of the electrode, the provision of a pressure equalizing chamber on the backside of the electrode, the provision of a plurality of through holes 52 communicating with the pressure equalizing chamber in the electrode and the provision of a communicating portion for communicating individual pressure equalizing chambers to each other contribute to the prevention of vibration (fluttering phenomenon) of the strip and adsorption of the strip on the electrode.

The present inventors have confirmed the prevention of vibration (fluttering phenomenon) of the strip and adsorption of the strip to the electrode by the following experiment.

In the experiment, electrodes were placed opposite a strip, water was fed into a space between the electrodes, and the variation in the liquid pressure within the space between the electrodes and the vibration of the strip were measured. The results are given in Table 1. As is apparent from Table 1, when the electrode had no hole (test No. 1), the variation in the liquid pressure within the space between the electrodes and the vibration of the strip were both large. On the other hand, it was found that when holes were provided in the electrodes and a pressure equalizing chamber was provided (test No. 2), the vibration of the strip was very small. In test No. 1, the variation in pressure within the space between the electrodes acted on the strip to give rise to vibration. On the other hand, in test No. 2, the variation in the pressure was remarkably reduced, and the vibration of the strip became very small. Thus, the experiment conducted by the present inventors has revealed that the provision of a plurality of holes in the electrodes for communicating the space between the electrodes with the equalizing chamber enables the variation in the pressure within the space between the electrodes to be scattered towards the pressure equalizing chambers.

TABLE 1

| Test No. | Test condition | (flow rate in space between electrodes: 1.5 m/sec) Variation in pressure | Vibration of strip |
|---|---|---|---|
| 1 | No hole in electrode | 50–600 mmAq | 30–60 mm |
| 2 | Provision of holes in electrode and provision of pressure equalizing chamber | 10–50 mmAq | 0–4 mm |

With respect to the adsorption of the strip to the electrode, as described above, the vibration of the strip gives rise to the adsorption. Further, when the cell on the side of the surface of the strip and the cell on the side of the reverse surface of the strip are assumed to be chamber A and chamber B, respectively, the adsorption phenomenon occurs also in the case where a difference in the pressure occurs between the chamber A (PA) and the chamber B (PB). For example, when PA>PB, the strip moves towards the chamber B.

For the reasons set out above, the provision of a communicating portion for communicating pressure equalizing chambers provided on the backside of respective electrodes with each other is useful for reducing the variation in the pressure within the space between the electrodes and, at the same time, reducing the difference in the pressure between the surface and the reverse surface of the strip.

Specifically, the electrolyte feeding nozzle is divided into at least two nozzle chambers by means of a partition wall; an electrolyte feeding port is provided on both sides of the primary nozzle chamber, and the partition wall is provided with a slit having a space of a size gradually increasing from the center to both of a size gradually increasing from the center to both sides. This enables the turbulent flow of the electrolyte to be rectified the flow rate of the electrolyte is made to be homogeneous not only in the widthwise direction of the slit but also on the surface and the reverse surface of the strip, and the thickness of plating and the quality of plating is made to be homogeneous. Further, the flow rate of the waste electrolyte can be made homogeneous not only in the widthwise direction of the strip but also on the surface and the reverse surface of the strip by virtue of the provision of a waste electrolyte box at the top or bottom of the electrode box, a waste electrolyte outlet, a partition wall surrounding the strip provided inside the waste electrolyte box and waste electrolyte equipment having a plurality of through holes in the partition wall.

Further, as with the electrode box, the partition wall has a plurality of through holes, which prevents the vibration (fluttering phenomenon) of the strip and the adsorption of the strip to the electrode in the waste electrolyte equipment as well.

Further, the experiment conducted by the present inventors has revealed that the provision of an electrolyte feeding device for feeding a small amount of an electrolyte into the pressure equalizing chamber provided on the backside of each electrode can further reduce the variation in the pressure of the pressure equalizing chamber. Further, it has also become possible to successively replace the electrolyte of the pressure equalizing chamber with a fresh electrolyte.

The present invention will now be described in more detail with reference to the accompanying drawings. It is needless to say that the present invention is not limited to the following embodiments.

Figure 4:
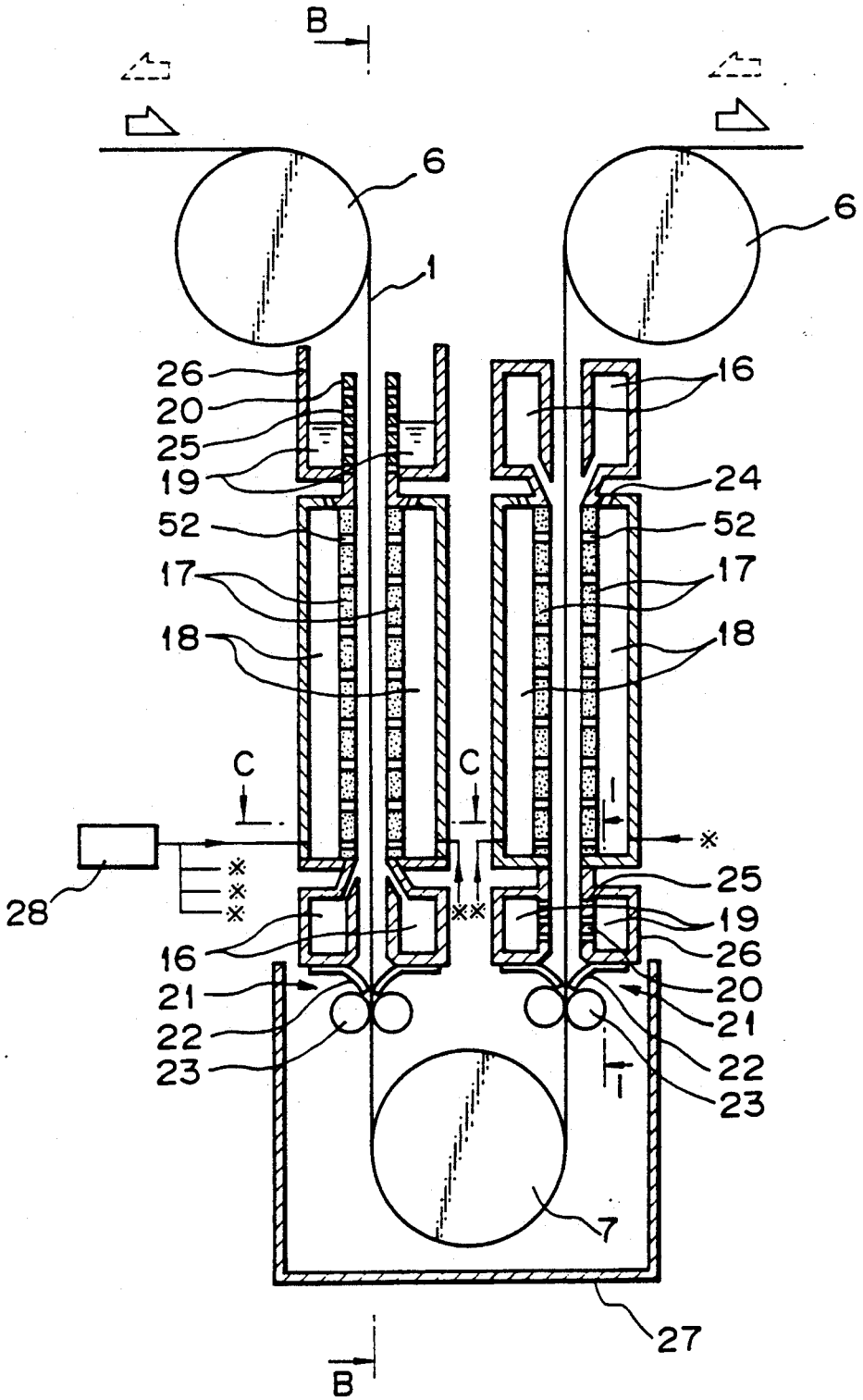
FIG. 4 is a sectional side longitudinal view of an embodiment of the vertical type stream plating apparatus according to the present invention.
Figure 5:
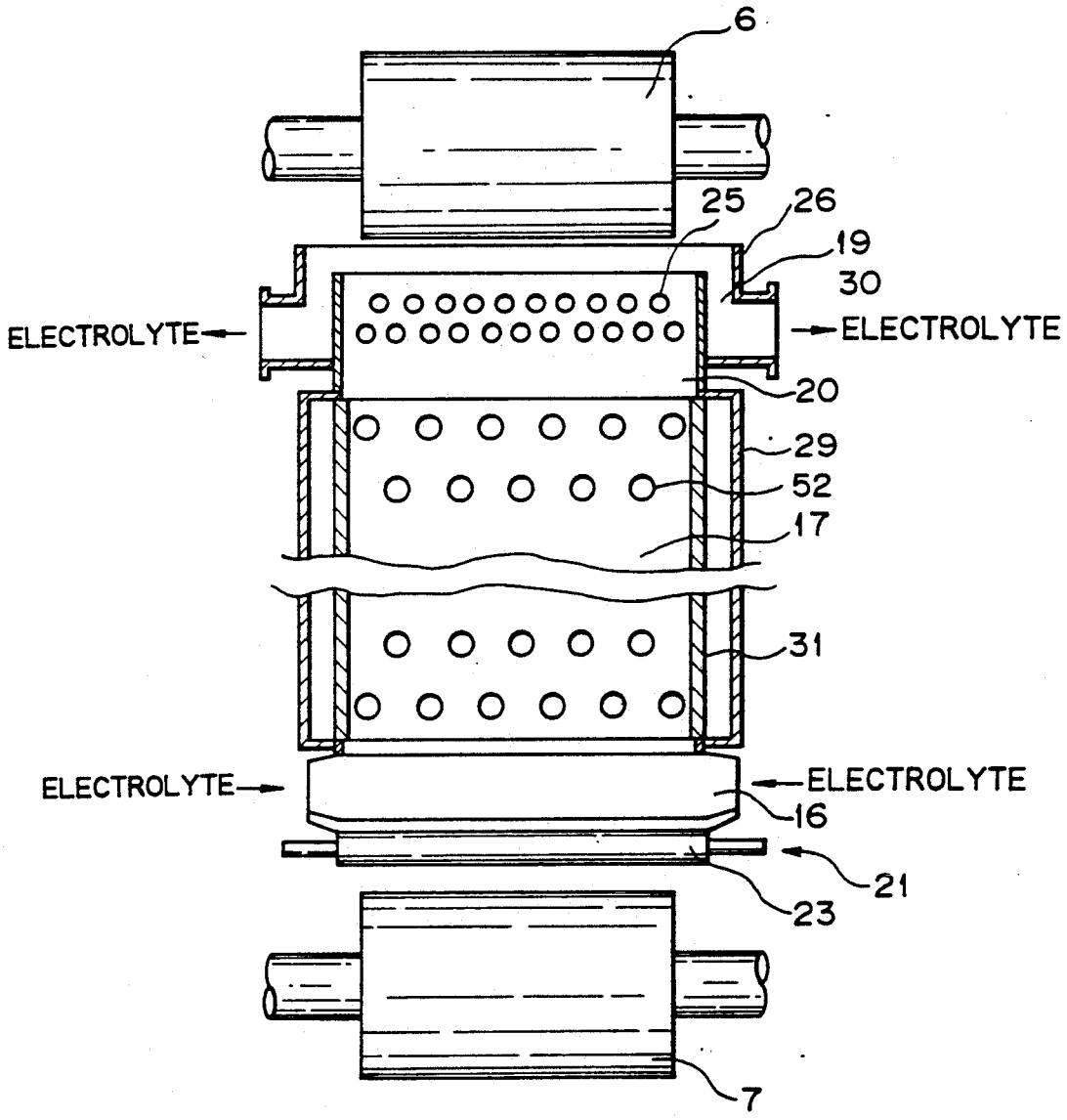
FIG. 5 is a sectional view taken on line B—B of FIG. 4.
Figure 6:
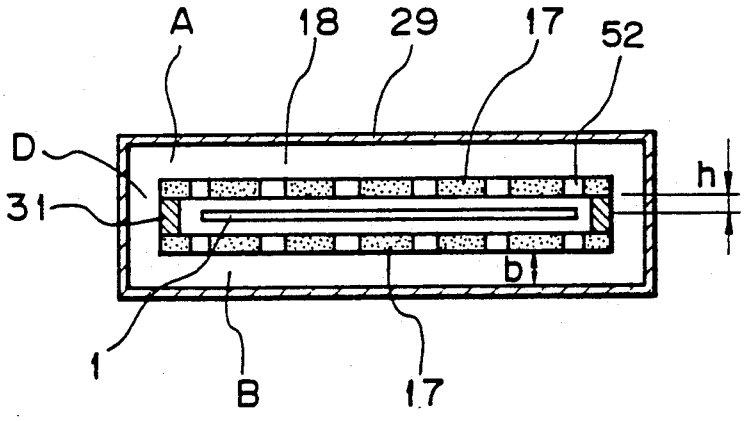
FIG. 6 is a sectional view taken on line C—C of FIG. 4.

FIGS. 4, 5 and 6 are diagrams showing an embodiment of the present invention. In the present invention, a strip 1 is energized as a cathode by means of a conductor roll 6 and travels in a direction indicated by a solid line arrow. An electrolyte feeding nozzle 16 is provided on the side of an outlet of the strip 1 in the longitudinal direction of the electrode 17 to feed an electrolyte. A pressure equalizing chamber 18 is provided on the backside of each electrode 17. Further, a plurality of through holes 52 are provided in the electrode towards the pressure equalizing chamber 18, and the chamber A and the chamber B of the pressure equalizing chamber 18 are allowed to communicate with each other.

It is preferred that the size of the through hole 52 of the electrode by 1 to 10 times the distance (h) between the surface of the electrode and the center of the strip and the total area of the holes provided in the electrodes be about 5 to 10% of the total area of the electrode. The pitch of the holes is 5 to 20 times the distance (h) between the surface of the electrode and the center of the strip, and the distance (h) between the surface of the electrode and the center of the strip was set to 15 mm. Since the distance (2h) between the electrodes is twice this value, it is 30 mm.

The depth (b) of the pressure equalizing chamber 18 is 20 to 60 mm, and is about two to four times the distance (h). A communicating portion D for communicating the chamber A and the chamber B of the pressure equalizing chamber 18 with each other is provided both sides of the pair of electrodes.

In FIG. 6, a communicating portion is housed in a box common to the pressure equalizing chambers and the communicating portion. However, the communicating portion may comprise a pipe that connects both pressure equalizing chambers to each other.

A side seal 31 is provided at both ends in the widthwise direction of the electrode for partition into an electrode 17 and a pressure equalizing chamber 18. A vent hole 24 is provided at the top of the pressure equalizing chamber 18 to release a gas within the pressure equalizing chamber to the atmosphere.

An upper waste electrolyte equipment 19 is provided at the top of the electrode 17, and lower waste electrolyte equipment 19 is provided at the bottom of the electrode 17, and this waste electrolyte equipment is placed opposite and separated from the strip 1 by means of a partition wall 20 having a plurality of holes 25.

A seal equipment 21 is provided at the bottom of the electrolyte feeding nozzle 16 and the lower waste electrolyte equipment 19, and comprises a pair of rotatable damrolls 23 with the strip 1 being sandwiched therebetween and a seal plate 22.

Regarding the relationship between the direction of flow of the electrolyte and the direction of advancement of the strip, when the electrolyte flows in a direction opposite the direction of advancement of the strip, the surface of the strip is agitated by the electrolyte. On the other hand, when the electrolyte flows in the same direction as that of advancement of the strip, a gas generated by the electrolysis is not restricted by the advancement of the strip and can be easily discharged. Therefore, in the above embodiment, although the direction of advancement of the strip 1 is as indicated by a solid line arrow in FIG. 4 and the electrolyte flows in a direction opposite the direction of advancement of the strip, the electrolyte may flow in the same direction as that of advancement of the strip as indicated by a broken line arrow in FIG. 4, depending upon various conditions such as operating conditions, construction of the apparatus, feed of the electrolyte and provision of a waste electrolyte pipe. Further, as shown in FIGS. 7 and 8, it is also possible to adopt a combination of the flow of the electrolyte in a direction opposite the direction of advancement of the strip with the flow of the electrolyte in the same direction as that of advancement of the strip.

Figure 7:
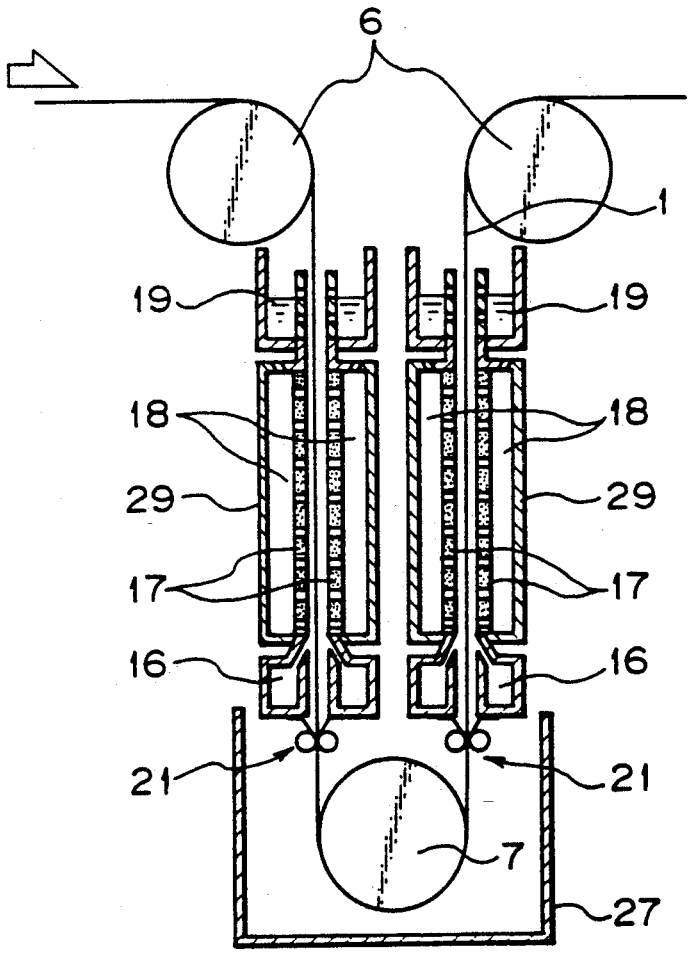
FIG. 7 is a sectional side longitudinal view of another embodiment of the vertical type stream plating apparatus according to the present invention, wherein an electrolyte feeding nozzle is provided only at the bottom of each electrode.
Figure 8:
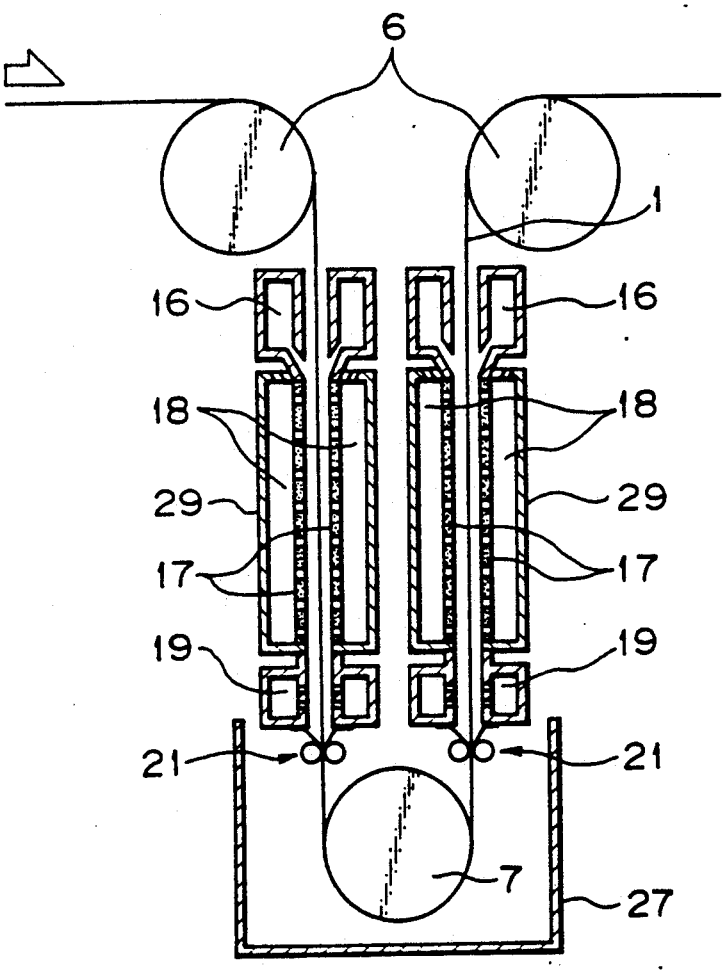
FIG. 8 is a sectional side longitudinal view of a further embodiment of the vertical type stream plating apparatus according to the present invention, wherein an electrolyte feeding nozzle is provided at the top of each electrode.
Figure 9:
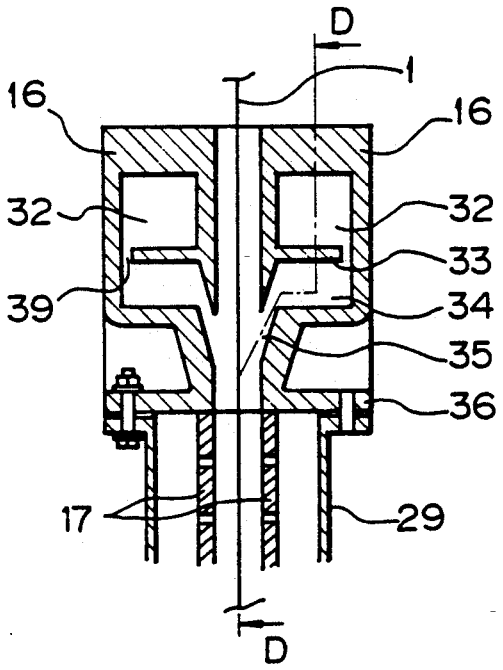
FIG. 9 is a sectional side longitudinal view of an embodiment of the electrolyte feeding nozzle according to the present invention.
Figure 10:
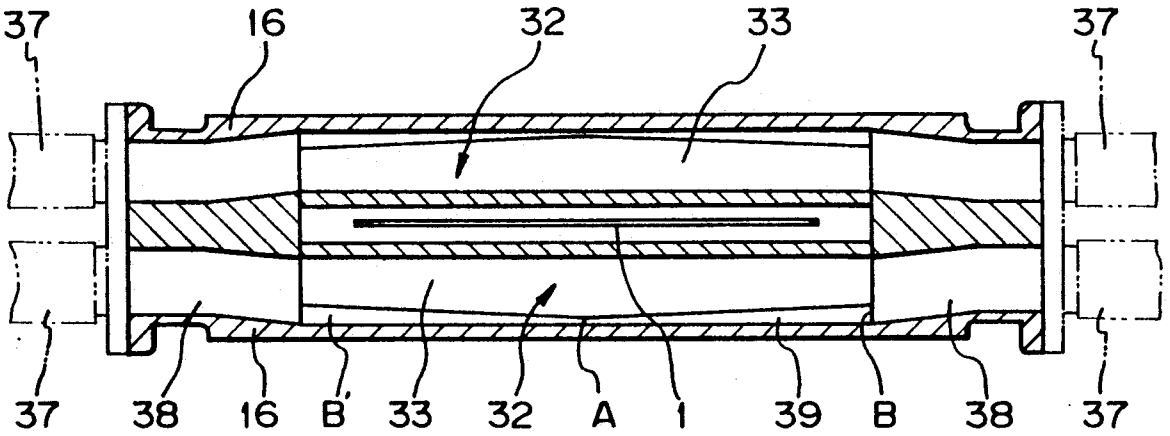
FIG. 10 is a sectional view of the electrolyte feeding nozzle in the widthwise direction of a strip according to the present invention taken on line E—E of FIG. 12.

With respect to FIGS. 7 and 8, FIG. 7 shows an embodiment wherein an electrolyte feeding nozzle 16 is provided only at the bottom of the electrode, while FIG. 8 shows an embodiment wherein an electrolyte feeding nozzle is provided only at the top of the electrode. The electrolyte feeding nozzle according to the present invention is shown in FIGS. 9 and 10. The electrolyte is introduced into an electrolyte feeding port 38 through an electrolyte feeding pipe 37. An electrolyte feeding nozzle 16, a primary nozzle chamber 32 and a secondary nozzle chamber 34 are separated from each other by means of a partition wall 33. Further, the passage of the partition wall 33 is tapered in such a manner that the center portion A of the nozzle is narrower than the end portion B. It is preferred that the size of the slit be about 10 mm in the center portion A and about 30 mm in the end portion B. In this drawing, the electrolyte is fed into the electrode 17 through a jetting port 35.

Figure 11:
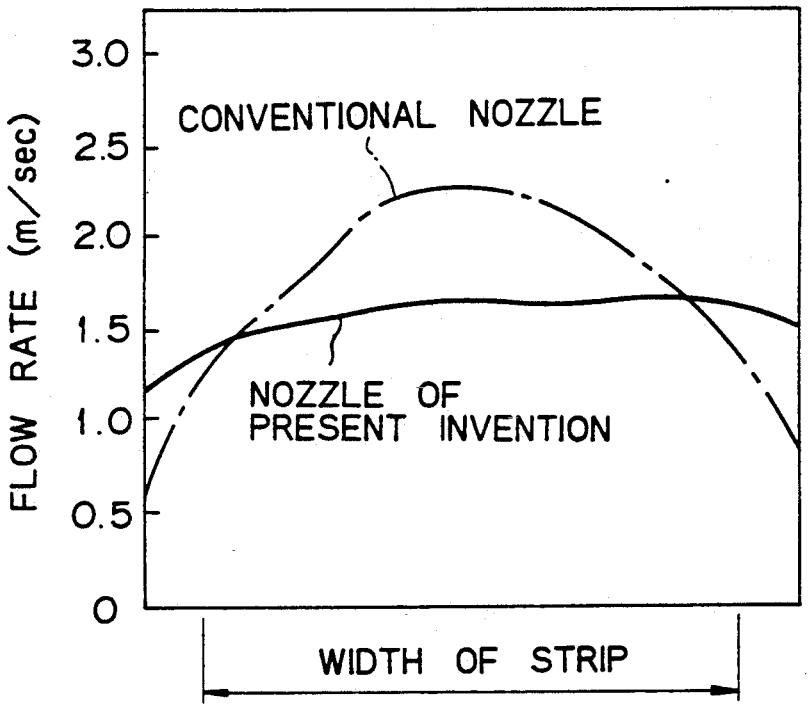
FIG. 11 is a graph showing the flow rate distribution of the electrolyte feeding nozzle according to the present invention and the conventional nozzle.

As is apparent from FIG. 11, the application of the electrolyte feeding nozzle according to the present invention contributes to a remarkable improvement in the flow rate distribution of the electrolyte in the widthwise direction of the strip over the conventional nozzle.

The electrolyte feeding device 28 shown in FIG. 4 serves to feed a small amount of an electrolyte into the pressure equalizing chamber. Specifically, it feeds the electrolyte in an amount of about 1/10 to 1/50 of the amount of electrolyte flowing through the electrolyte feeding nozzle into the space between the electrodes.

Embodiments in connection with the whole constitution of the present invention have been described above. Individual devices constituting the apparatus of the present invention will now be described.

At the outset, the electrolyte feeding nozzle will be described in more detail.

Figure 12:
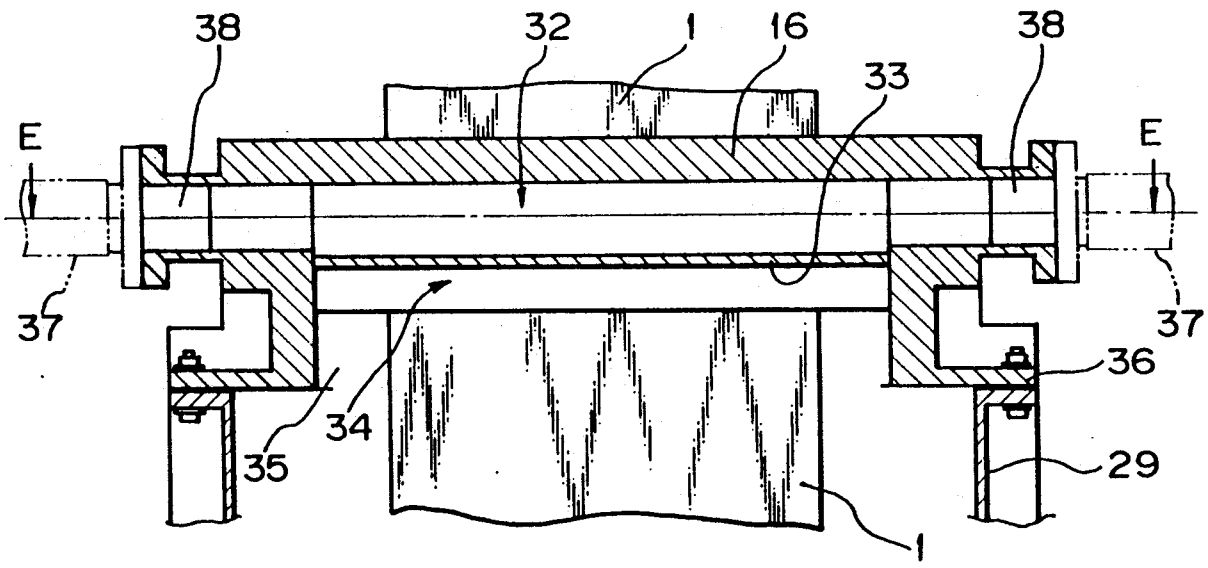
FIG. 12 is a sectional view of the electrolyte feeding nozzle according to the present invention taken on line D—D of FIG. 9.

FIG. 9 is a sectional side longitudinal view of an embodiment of the electrolyte feeding nozzle according to the present invention, and FIG. 12 is a sectional view taken on line D-D of FIG. 9. FIG. 10 is a sectional view taken on line E-E of FIG. 12. As shown in FIG. 9, the electrolyte feeding nozzle 16 is positioned on both surfaces of the strip 1. As shown in FIG. 10, the electrolyte is fed through four electrolyte feeding pipes 37. In one nozzle, the electrolyte fed through one electrolyte feeding port is combined with the electrolyte fed through another electrolyte feeding port in the primary nozzle chamber in such a manner that these electrolytes collide with each other. Therefore, when the static pressure distribution within the primary nozzle chamber is taken into consideration, the static pressure of the center portion in the nozzle chamber is necessarily high.

The electrolyte combined in the primary nozzle chamber flows into the secondary nozzle chamber through a slit defined by a partition wall and the wall of the nozzle and ejected through the jetting port towards the strip 1. In this case, the slit 39 has a space of a size gradually increasing from the center portion A to the vicinity of the electrolyte feeding port B. Specifically, the structure of the slit is such that it is difficult for the electrolyte to flow out from the center portion while the electrolyte easily flows out from the vicinity of the electrolyte feeding port. This structure and the balance of the static pressure distribution within the nozzle chamber enable a homogeneous flow rate distribution to be attained in the widthwise direction of the nozzle.

The electrolyte feeding nozzle 16 is positioned on both surfaces of the strip 1. Specifically, in this embodiment, the electrolyte is fed on both surfaces of the strip 1.

The electrolyte feeding nozzle 16 is fixed to a cell body 29 by means of a flange. As shown in FIG. 10, the electrolyte is fed through two electrolyte feeding pipes 37. The electrolyte fed through one electrolyte feeding pipe is combined with the electrolyte fed through the other electrolyte feeding pipe in the primary nozzle chamber 32.

The size of the primary nozzle 32 need not be very large and is substantially the same as that of the electrolyte feeding port. The flow rate of the electrolyte fed through the electrolyte feeding port is as high as about 3 m/sec. The electrolyte fed through one electrolyte feeding port is combined with the electrolyte fed through the other electrolyte feeding port in the primary nozzle chamber in such a manner that these electrolytes collide with each other. Therefore, when the static pressure distribution within the primary nozzle chamber is taken into consideration, the static pressure of the center portion in the nozzle chamber is necessarily high. The electrolyte combined in the primary nozzle chamber 32 flows into the secondary nozzle chamber through a slit 39 defined by a partition wall 33 and the wall of the nozzle 16. In this case, the slit 39 has a space of a size gradually increasing from the center portion A to the vicinity of the electrolyte feeding port B. In this embodiment, the size of the slit is about 10 mm in the slit portion A and about 30 mm in the slit portion B.

Although the size of the secondary nozzle chamber should be such that flow of the electrolyte becomes homogeneous, it may be smaller than that of the primary nozzle chamber. The electrolyte flowing into the secondary nozzle chamber is finally ejected towards the strip 1 through a jetting port having an identical space in the widthwise direction of the nozzle. The direction of the jetting port is preferably parallel to the strip 1 as much as possible from the viewpoint of strip 1 vibration prevention. However, this is difficult because of the limitation of the structure. In an embodiment of the present invention, the angle of the direction of the jetting port to the strip is 15°.

The embodiments of the present invention has been described above. Jetting of the electrolyte is not limited to jetting downward to the strip 1, and the electrolyte may be jetted upward to the strip 1 or parallel to the strip 1. Further, the electrolyte feeding nozzle may be positioned on both surfaces of the strip as shown in FIG. 9. Alternatively, it may be positioned only one surface of the strip. Further, the electrolyte feeding nozzle of the present invention can be sufficiently applied to not only plating but also an apparatus for conducting pickling, degreasing, etc.

The electrolyte feeding nozzle according to the present invention has been described above with reference to the accompanying drawing, though the present invention is not limited only to these embodiments. The variation and modification of these embodiments are possible depending upon the purpose of the feeding nozzle. It is a matter of course that said variations and modifications should not be construed as departing from the scope of the invention.

The waste electrolyte equipment according to the present invention will now be described in more detail with reference to the accompanying drawings.

Figure 13:
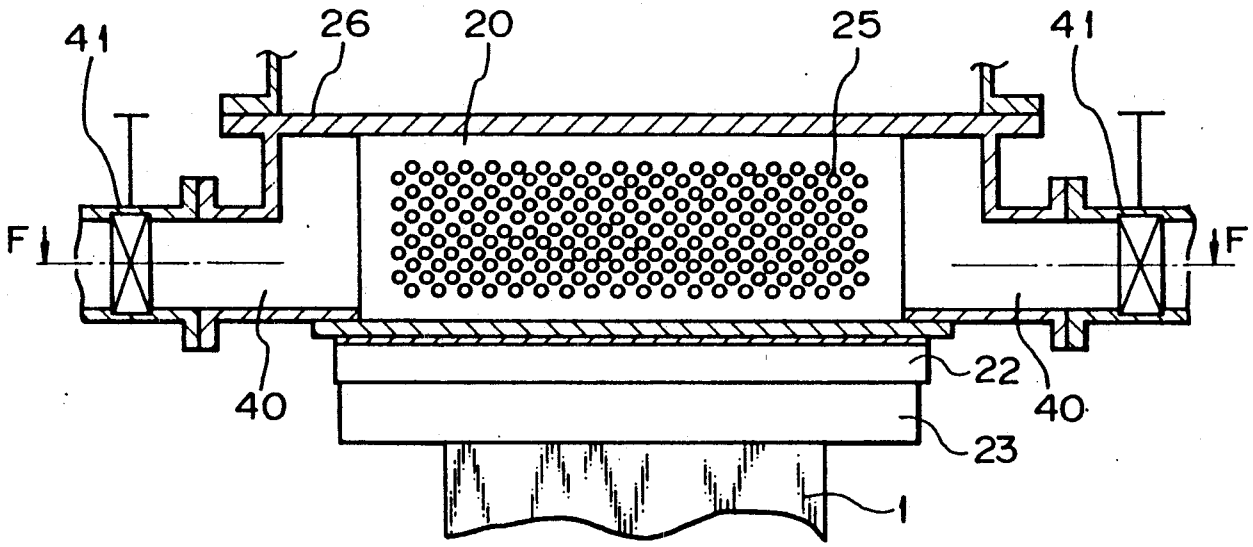
FIG. 13 is a sectional view of waste electrolyte equipment in the widthwise direction of a strip provided at the bottom of the electrolytic cell according to the present invention.
Figure 14:
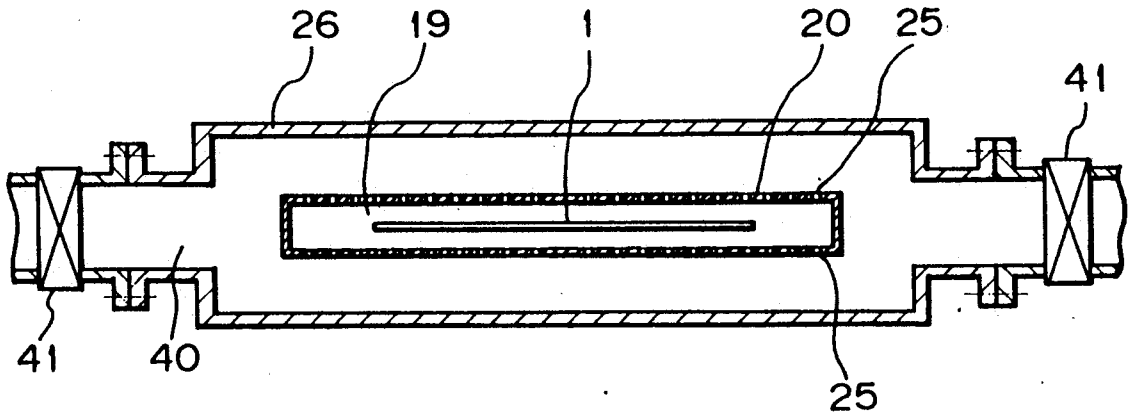
FIG. 14 is a sectional view of waste electrolyte equipment provided at the bottom of the cell according to the present invention taken on line F—F of FIG. 13.

FIG. 13 is a front sectional view of a waste electrolyte equipment according to the present invention, and FIG. 14 is a sectional view taken on line F-F of FIG. 13. As shown in FIGS. 13 and 14, the electrolyte flows into the cell body, and the whole quantity of the electrolyte enters the inside of the partition wall 20. Most of the electrolyte is passed through holes 25 provided in the partition wall 20 and discharged through a waste electrolyte outlet 40 provided on both sides of the waste electrolyte box. The storage of a predetermined amount of the electrolyte in the cell body can be attained by adjusting the opening of the flow valve 41 provided in the waste electrolyte outlet.

The partition wall 20 at its portion facing both surfaces of the strip has a plurality of holes 25, and the partition wall 20 and the waste electrolyte box 26, excepting the through holes 25 and the seal plate 22, are substantially hermetically sealed so that substantially the whole quantity of the electrolyte fed through the electrolyte feeding pipe 37 provided at the top of the cell body 29 flows into the interior of the partition wall.

The partition wall 20 is connected to the waste electrolyte box 26 for manufacturing reasons, and the waste electrolyte box 26 may be integral with the partition wall 20. Most of the electrolyte flowing into the interior of the partition wall 20 flows into the waste electrolyte box 26 via through holes 25 provided in the partition wall 20. A homogeneous descending flow rate is attained on the strip 1 when the through holes 25 are provided in the partition wall at its portion facing both surfaces of the strip and no through hole is provided in the portion of the partition wall 20 facing the waste electrolyte outlet 40.

The through hole has a size of about 20 mm, and is preferably provided as densely as possible. When the flow rate is high, a larger number of through holes are preferably provided around the center of the partition wall. Most of the electrolyte flowing from both surfaces of the strip 1 into the waste electrolyte box 26 is concentrates in the waste electrolyte box 26 and flows outside of the system through the valve 41. A very small amount of the electrolyte flows outside of the system through the space between the lower seal plate 22 and the damroll.

The valve 41 can be arbitrarily adjusted according to the amount of electrolyte from the upper part of the apparatus. The position of the valve 41 is not limited to the immediate vicinity of the waste electrolyte box 26, and may be positioned away from the waste electrolyte box so that maintenance can be easily effected.

The electrolyte seal equipment according to the present invention will now be described in more detail.

Figure 15:
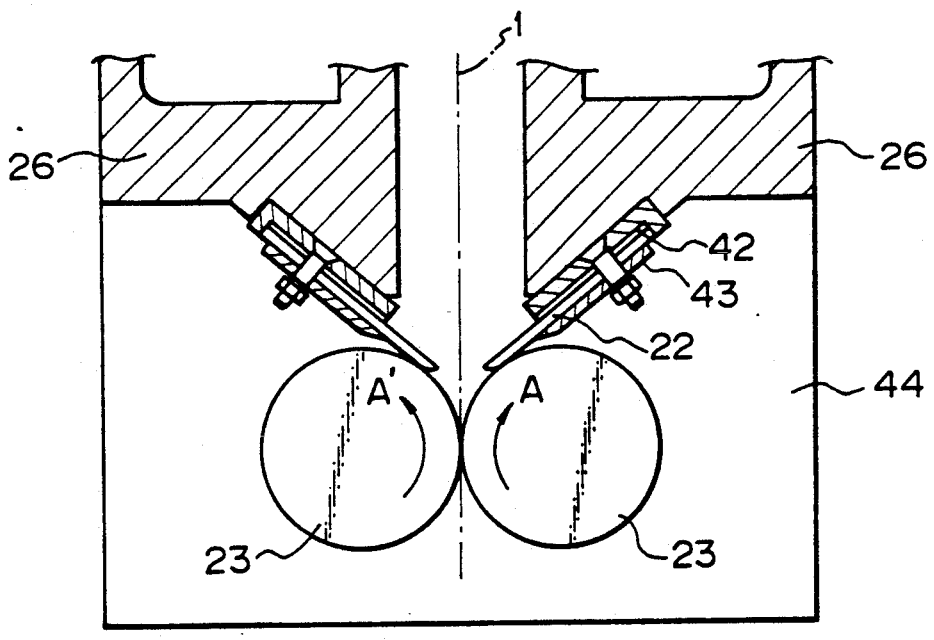
FIG. 15 is a front sectional view of the seal device according to the present invention.

FIG. 15 is a front sectional view of the electrolyte seal equipment according to the present invention. As shown in FIG. 15, the strip 1 is pinched by means of the damrolls 23. The sealing between the strip and the damrolls for preventing the electrolyte from passing between the strip and the damrolls is attained by pinching, and the damrolls are rotated following the travel of the strip. The upper seal plate 22 is provided so as to come into contact with the outer periphery of the damroll. This ensures a seal between a damroll and the seal plate and prevents the electrolyte from passing between the damroll and the seal plate. At the same time, the side of the seal plate is in contact with the surface of the edge seal 44 to prevent the electrolyte from leaking out in the direction of the side. A seal ring is inserted between the edge seal 44 and the roll to eliminate the space. In general, the seal ring is fixed to the roll and is rotatable. Alternatively, it may be fixed to the edge seal and be unrotatable.

The diameter of the damroll is about 100 mm when the thickness of the strip is as small as 0.3 mm. The damroll preferably comprises an insulating material such as rubber lining. The upper seal plate should comprise a rigid material, because when the seal plate is bent by the liquid pressure, the seal plate comes into contact with the damroll, which increases the rotational resistance, so a larger drive unit should be used. When the sheet plate comprises a soft material such as a rubber plate, the seal plate adhers to the damroll by the liquid pressure, so that the seal plate is caught between the damrolls or between the damroll 23 and back plate 43, which makes it possible to sufficiently prevent the passing of the electrolyte. In some cases, this damages the seal plate.

The upper seal plate has a thickness of about 5 mm, and preferably comprises a rigid, insulating material such as PVC (vinyl chloride), FRP or teflon. The length of the projected portion of the upper seal plate is preferably as small as possible for the purpose of minimizing the liquid pressure. If the length cannot be reduced, it is preferable to provide a back plate 43 as shown in FIG. 15 so as to prevent the seal plate from bending. The adjustment of the gap between the seal plate and the damroll can be attained by varying the thickness of a liner 42.

The seal ring inserted between the edge seal and the edge of the roll preferably comprises an elastic material such as rubber. The elasticity has the effect of eliminating the gap. The outer diameter of the seal ring is preferably the same as the diameter of the damroll.

A further embodiment of the present invention is such that an intermediary electrolyte reservoir at the top of the electrolytic cell communicates with a secondary electrolyte feeding port provided at the top of another electrolytic cell.

Figure 16:
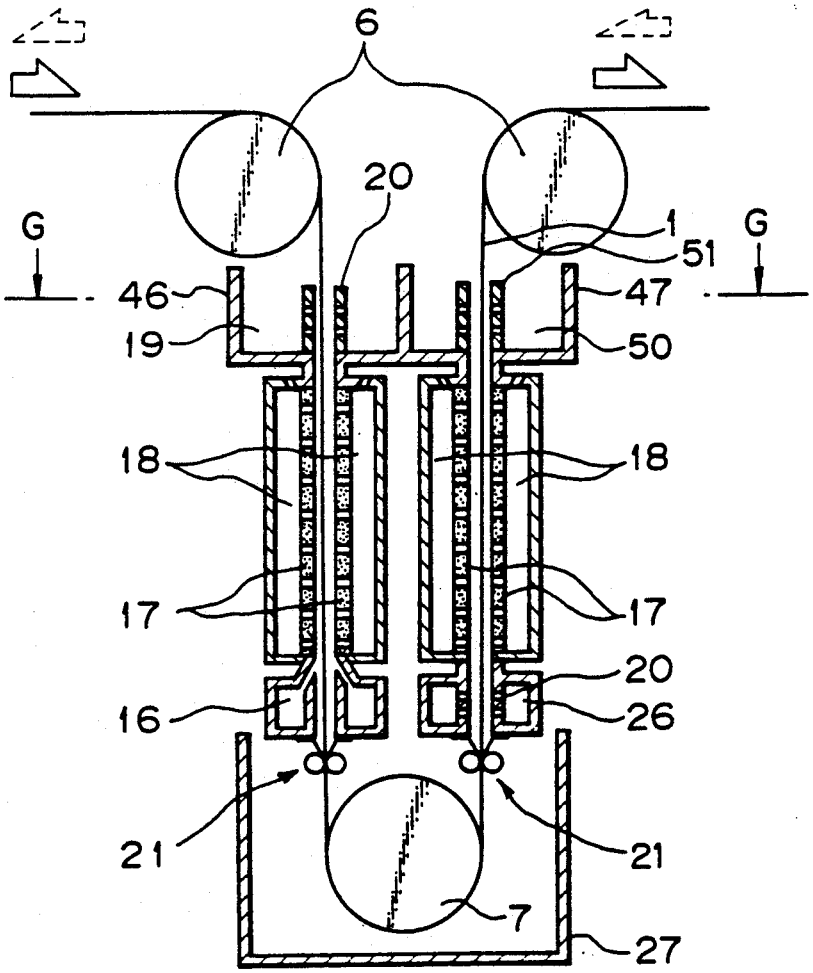
FIG. 16 is a sectional side longitudinal view of an embodiment of the present invention wherein an intermediary electrolyte reservoir communicates with a secondary electrolyte feeding port by means of a communicating pipe.
Figure 17:
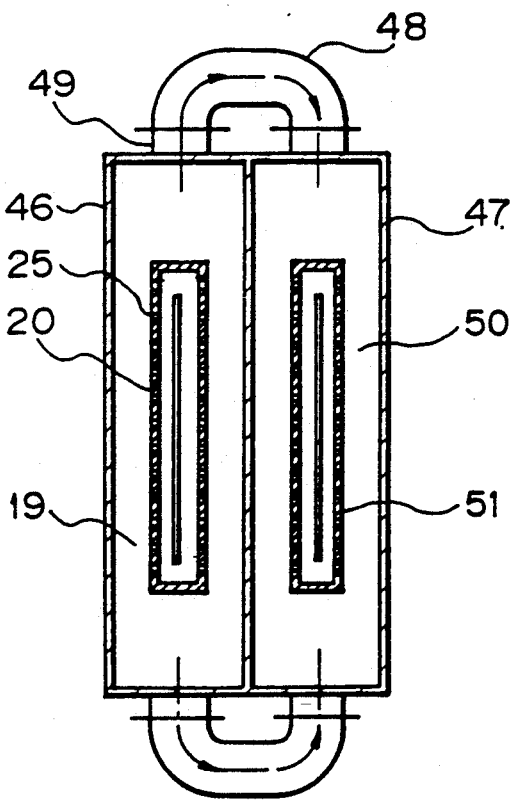
FIG. 17 is a sectional view taken on line G—G of FIG. 16.

As shown in FIGS. 16 and 17, the strip 1 is energized as a cathode by means of a conductor roll 6. The primary electrolyte feeding nozzle 16 is provided at the bottom of the electrode 17 and serves to feed the electrolyte and produce an agitation effect. The electrolyte seal equipment 21 provided at the bottom of the primary electrolyte feeding nozzle 16 prevents the electrolyte from flowing outside of the system.

Examples of the electrolyte seal equipment 21 include a sealing method wherein two rolls are pressed against each other with the strip 1 being sandwiched therebetween and a sealing method wherein a rubber plate is pushed against the strip. What is important is that the electrolyte can be efficiently fed into the electrodes 17. A side seal 31 is provided on both sides in the widthwise direction of the electrode 17 to prevent an outflow of the electrolyte in the widthwise direction of the electrode. An intermediary electrolyte reservoir 46 serves to transfer the electrolyte passed between the electrodes to the secondary electrolyte feeding port 47, and comprises a partition wall 20 facing the strip 1, an electrolyte reservoir 19 and a communicating pipe 48. The partition wall 20 has a plurality of holes 25, and an electrolyte outlet nozzle 49 for the communicating pipe 48 is provided at the bottom of the electrolyte reservoir 19.

Figure 18:
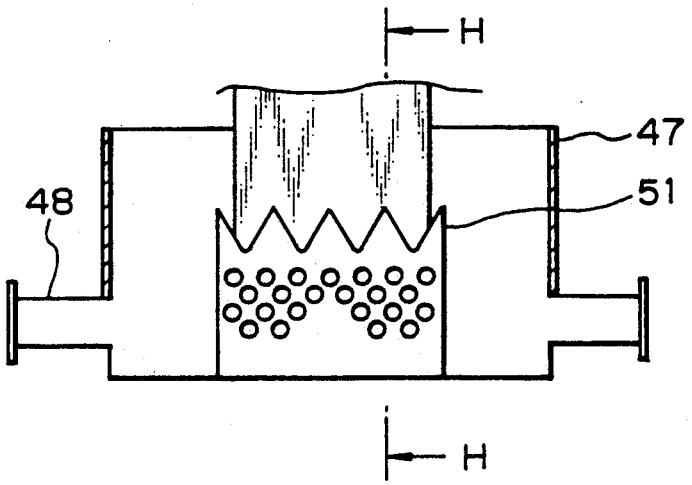
FIG. 18 is an explanatory view of a secondary electrolyte feeding port in an embodiment of the present invention wherein an intermediary electrolyte reservoir communicates with a secondary electrolyte feeding port by means of a communicating pipe.
Figure 19:
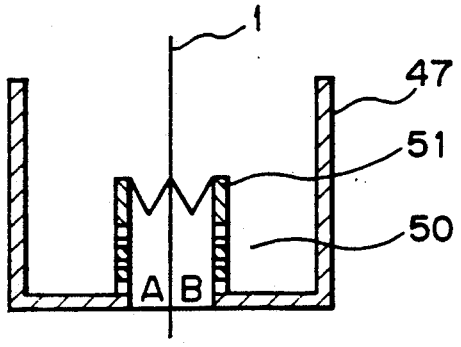
FIG. 19 is a sectional view taken on line H—H of FIG. 18.

As shown in FIGS. 18 and 19, the secondary electrolyte feeding port 47 comprises an electrolyte receiver 50 and a partition wall 51, and one end of the communicating pipe 48 is connected to the electrolyte receiver 50. The top of the partition wall 51 has a sawtooth form that prevents ruffling of the surface of the electrolyte. Further, the partition wall 51 has a plurality of holes, and the holes are densely provided from the center towards the end in the widthwise direction of the strip so that the flow rate of the electrolyte is homogenous in the widthwise direction.

The electrolyte discharge equipment 26 comprises a partition wall 20 and a seal equipment 21 and serves to discharge the electrolyte to the outside of the system. It is preferred that the partition wall 20 have a plurality of holes. Examples of the seal equipment 21 include a sealing method wherein two rolls are pressed against each other with the strip being sandwiched therebetween and a sealing method wherein sealing is conducted by using a rubber plate. What is important is that entry of air from the bottom can be prevented.

As described above, the present invention is directed to a vertical type stream plating apparatus comprising at least one of a pair of two electrolytic cells for treating the surface of a metal comprising a pair of facing electrodes 17 provided while leaving a predetermined space therebetween; said space containing an electrolyte stream in the longitudinal direction of said electrodes, a metal strip 1 travelling through the space between said electrodes for electroplating said metal strip; said plating apparatus further comprising: a primary electrolyte feeding nozzle 16 provided at the bottom of one electrolytic cell, an intermediary electrolyte reservoir 46 provided at the upper portion of said primary electrolyte feeding nozzle, a secondary electrolyte feeding port 47 provided at the upper portion of the other electrolytic cell, an electrolyte discharge equipment 26 provided at the bottom of said electrolytic cell, and a communicating pipe 48 for communicating said intermediary electrolyte reservoir 46 with said secondary electrolyte feeding port 47.

In the above-described construction, since two electrolytic cells are connected to each other in series, the necessary amount of electrolyte can be halved compared with the embodiment wherein an electrolyte is independently fed into two respective electrolytic cells. Therefore, the capacity of a storage tank for storing the electrolyte can also be halved. Further, piping and pump for feeding the electrolyte can be simplified.

The whole constitution of the present invention and embodiments of individual devices have been described above. The present invention enables the following significant effects to be attained.

First, in a vertical type stream plating apparatus wherein a plating solution is forcibly fed into a narrow space between electrodes, a product free from the occurrence of crinkling or vibration of the strip can be obtained. This effect is significant when a strip is used having a thickness as small as 0.3 mm or less.

Second, it becomes possible to attain a high flow rate in a space between electrodes, so that the current density can be increased, which ensures a highly efficient plating operation, so that the number of plating devices can be reduced.

Third, vibration (fluttering phenomenon) of the strip and the adsorption of the strip to the electrode can be eliminated, which enables the distance between electrodes to be reduced from about 100 mm to 20 to 40 mm, which contributes to a reduction in the flow rate of the electrolyte fed into the space between the electrodes and, at the same time, contributes to a reduction in power consumption during plating owing to the reduction in the distance between electrodes.

Fourthly, since the flow rate of the electrode becomes homogeneous in the space between the electrodes, the thickness and the quality of plating can be homogenized.

Fifthly, the construction of intermediary electrolyte reservoir and secondary electrolyte feeding port can simplify the equipment such as a storage tank, piping and pump for feeding electrolyte, since the necessary amount of electrolyte can be halved.

We claim:

1. A vertical type stream plating apparatus for treating the surface of a metal comprising a pair of facing electrodes with a predetermined space therebetween; said space containing an electrolyte stream in the longitudinal direction of said electrodes, a metal strip travelling through the space between said electrodes for electroplating said metal strip; said plating apparatus further comprising:

a nozzle for feeding said electrolyte into the space between said electrodes to form said electrolyte stream; said nozzle being provided at a bottom or upper portion of said apparatus;

an electrode box containing said electrodes therein, said electrode box having a pressure equalizing chamber for equalizing the pressure between the front face and the backside of said strip; said pressure equalizing chamber being provided on the backside of each electrode having a plurality of through holes for conducting said electrolyte into said pressure equalizing chamber; said pressure equalizing chamber having a sideseal formed at both ends of said electrodes by a plurality of short side blocks in the widthwise direction of each electrode;

waste electrolyte equipment provided with a waste electrolyte box for gathering and discharging the electrolyte discharged from said space between said electrodes; and seal equipment provided at the bottom portion of said stream plating apparatus for preventing the outflow of the electrolyte.

2. A vertical type stream plating apparatus according to claim 1, wherein said electrolyte feeding nozzle comprises a primary nozzle chamber and a secondary nozzle chamber partitioned from each other with a partition wall, an electrolyte feeding port provided on both sides of said first chamber, a slit provided between said primary and secondary chambers; said slit having a space of a size gradually increasing from the center to both sides and an electrolyte jetting port having an identical port space in the widthwise direction of the nozzle for feeding said electrolyte to said strip.

3. A vertical type stream plating apparatus according to claim 1, wherein said electrode box comprises said side seal for sealing both ends of the electrodes for preventing the outflow of said electrolyte from both sides of said electrodes; said pressure equalizing chamber provided on the backside of each electrode, a communicating portion for communicating said pressure equalizing chambers with each other, and said plurality of through holes provided in said electrodes for leading said electrolyte from a strip into each of the said pressure equalizing chambers.

4. A vertical type stream plating apparatus according to claim 1, wherein said waste electrolyte equipment comprises a partition wall surrounding said strip provided inside said waste electrolyte equipment; said partition wall having a plurality of through holes.

5. A vertical type stream plating apparatus according to claim 1, wherein said waste electrolyte equipment comprises a flow regulation valve for regulating the flow rate of waste electrolyte discharged from a waste electrolyte outlet, a sealing equipment provided at an outlet for the strip of said waste electrolyte box and a partition wall surrounding the strip provided inside the waste electrolyte box; said partition wall having a plurality of through holes.

6. A vertical type stream plating apparatus according to claim 1 that further comprises an electrolyte feeding device for feeding a small amount of an electrolyte into said pressure equalizing chamber provided on the backside of each electrode.

7. A vertical type stream plating apparatus according to claim 1, wherein said seal equipment comprises a pair of damrolls pressed against each other with said strip being sandwiched therebetween and rotatably following the travel of said strip, a seal plate provided on each damroll, an edge seal of said damroll combined with said seal plates on both sides and a seal ring provided in a space between said edge seal and the edge of said damroll.

8. A vertical type stream plating apparatus comprising at least one of a pair of two electrolytic cells for treating the surface of a metal comprising a pair of facing electrodes provided with a predetermined space therebetween; said space containing an electrolyte stream in the longitudinal direction of said electrodes, a metal strip travelling through the space between said electrodes for electroplating said metal strip; said plating apparatus further comprising:

a primary electrolyte feeding nozzle provided at the bottom of one electrolytic cell, an intermediary electrolyte reservoir provided at the upper portion of said primary electrolyte feeding nozzle, a secondary electrolyte feeding port provided at the upper portion of the other electrolytic cell, waste electrolyte discharge equipment provided at the bottom of said electrolytic cell, and a communicating pipe for communicating said intermediary electrolyte reservoir with said secondary electrolyte feeding port.

* * * * *

UNITED STATES PATENT AND TRADEMARK OFFICE

CERTIFICATE OF CORRECTION

PATENT NO. : 5,236,566

DATED : August 17, 1993

INVENTOR(S) : Kiyohide Tsuchiya, et al.

It is certified that error appears in the above-indentified patent and that said Letters Patent is hereby corrected as shown below:

On the title page, item [75] should read as follows:

[75] Inventors: Kiyohide Tsuchiya; Michihiro Shimamura; Katsuaki Nakagawa; Shuji Masuda; Kazuhiro Marumo; Tadashi Ogata, Yasuyuki Tashibu, all of Kitakyushu, Japan.

Signed and Sealed this

Eighth Day of March, 1994

Bruce Lehman

*Attest:*

BRUCE LEHMAN

*Attesting Officer*

*Commissioner of Patents and Trademarks*